US005810317A

United States Patent [19]

Macchi

[11] Patent Number: 5,810,317

[45] Date of Patent: Sep. 22, 1998

[54] CORNER HANGER ARRANGEMENT

[76] Inventor: Michael A. Macchi, 2205 Centre St., West Roxbury, Mass. 02132

[21] Appl. No.: 791,151

[22] Filed: Jan. 28, 1997

[51] Int. Cl.[6] ..... A47F 7/14

[52] U.S. Cl. ..... 248/475.1; 248/220.1; 248/300; 248/201

[58] Field of Search ..... 248/475.1, 477, 248/476, 495, 496, 300, 200, 220.1, 223.41, 247, 248, 546, 542, 201

[56] References Cited

U.S. PATENT DOCUMENTS

| | | | |
|---|---|---|---|
| 1,794,327 | 2/1931 | Simon | 248/495 |
| 3,112,912 | 12/1963 | Alvarez | 248/477 X |
| 3,318,561 | 5/1967 | Finke et al. | 248/300 X |
| 3,791,709 | 2/1974 | Cross | 248/496 X |
| 3,791,749 | 2/1974 | Grille et al. | 248/300 X |
| 4,712,761 | 12/1987 | Wassell | 248/475.1 |
| 4,957,251 | 9/1990 | Hubbard | 248/300 X |
| 5,042,766 | 8/1991 | Baker | 248/200.1 X |
| 5,138,134 | 8/1992 | Ellison | 248/476 X |
| 5,349,134 | 9/1994 | Russell | 248/220.1 X |

*Primary Examiner*—Leslie A. Braun
*Assistant Examiner*—Stephen S. Wentsler
*Attorney, Agent, or Firm*—Henderson & Sturm

[57] ABSTRACT

A corner hanger arrangement 10 for suspending artwork 200 from the adjacent wall surfaces 101, 102 of a corner 100. The arrangement 10 includes a pair of generally V-shaped bracket member 20 having a support arm 22 for receiving a picture hook 50 and a mounting arm 21 for receiving fasteners 40 for affixing the bracket members 20 to the wall surfaces 101, 102 and wherein the support arm 22 has access ports 24, 25 which are generally aligned with selected ones of the fasteners 40.

1 Claim, 2 Drawing Sheets

CORNER HANGER ARRANGEMENT

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

Description of Related Art

As can be seen by reference to the following U.S. Pat. Nos. 5,094,421; 5,154,384; 5,199,681; and 5,312,078; the prior art is replete with myriad and diverse picture hanging arrangements.

While all of the aforementioned prior art constructions are more than adequate for the basic purpose and function for which they have been specifically designed, they are neither designed nor intended to be employed in the same simple and efficient manner as the device that forms the basis of the present invention.

Most homes and apartments have a limited amount of wall space upon which to hang artwork, and this already limited space is further diminished by the presence of inwardly facing corners which heretofore have represented nothing but dead space which was not useful for any practical purpose.

As a consequence of the foregoing situation, there has existed a longstanding need in the marketplace for an apparatus that would allow artwork to be displayed in interior corner spaces in a simple and efficient yet unobtrusive manner, and the provision of such an arrangement is a stated objective of the present invention.

BRIEF SUMMARY OF THE INVENTION

Briefly stated, the corner hanger arrangement that forms the basis of the present invention comprises a pair of generally V-shaped bracket units that can be installed on adjacent interior corner wall surfaces to form a support platform for conventional picture hooks that will be used to suspend artwork at an angular orientation relative to each of the adjacent corner well surfaces.

As will be explained in greater detail further on in the specification, each of the V-shaped bracket units has a mounting arm and a support arm that are formed integrally with one another.

In addition, each mounting arm is provided with a plurality of apertures that are dimensioned to receive fastening means for fixedly securing the mounting arm in a flush fashion relative to one of the corner wall surfaces. The support arm is provided with access ports to facilitate the insertion of the fastening means in the apertures, as well as at least one elongated slot which is dimensioned to receive a portion of a conventional picture hook.

BRIEF DESCRIPTION OF THE SEVERAL VIEWS OF THE DRAWING

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
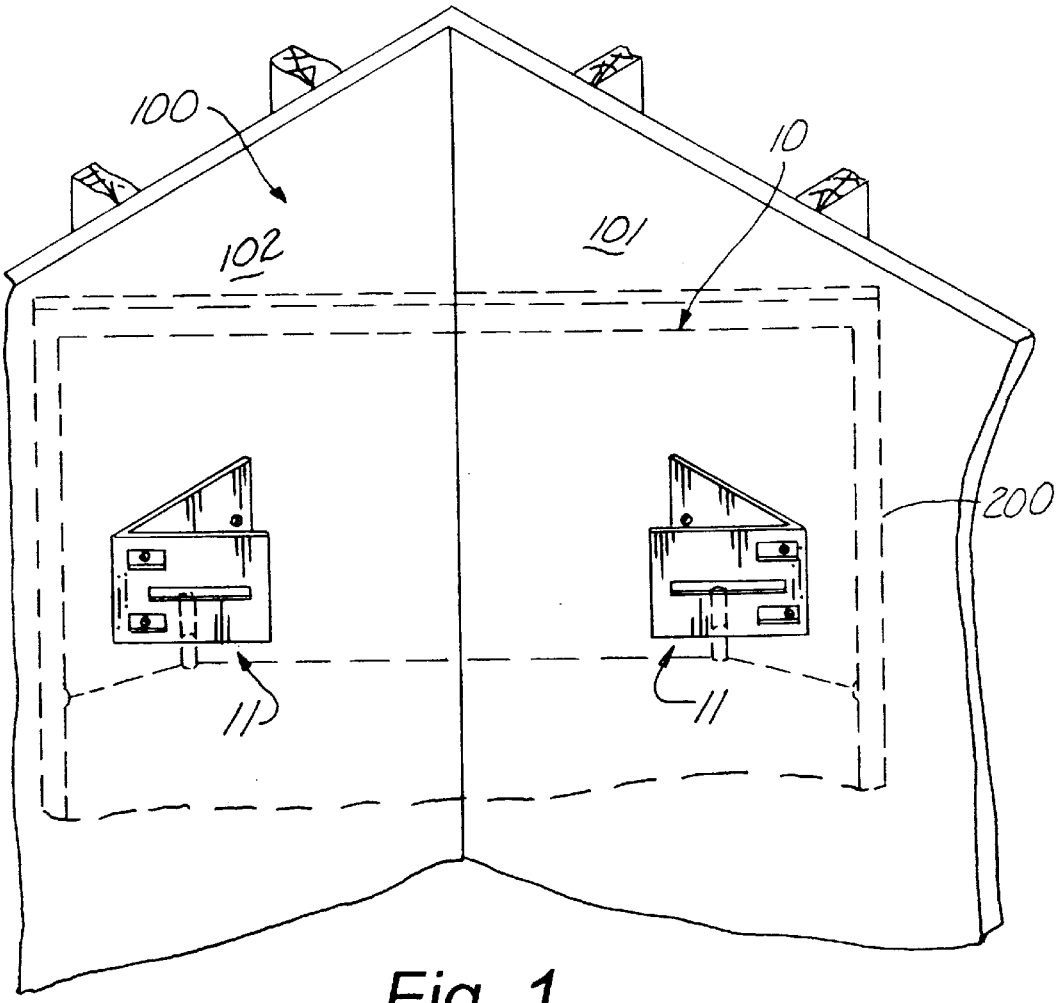
FIG. 1 is a perspective view of the corner hanger arrangement installed on the adjacent walls of an interior corner.

As can be seen by reference to the drawings, and in particularly to FIG. 1, the corner hanger arrangement that forms the basis of the present invention is designated generally by the reference number 10. The arrangement 10 comprises in general a pair of identical bracket units 11 wherein it will only be necessary to describe one of the bracket units 11 in detail in order to gain a thorough understanding of the subject matter of this invention.

Figure 2:
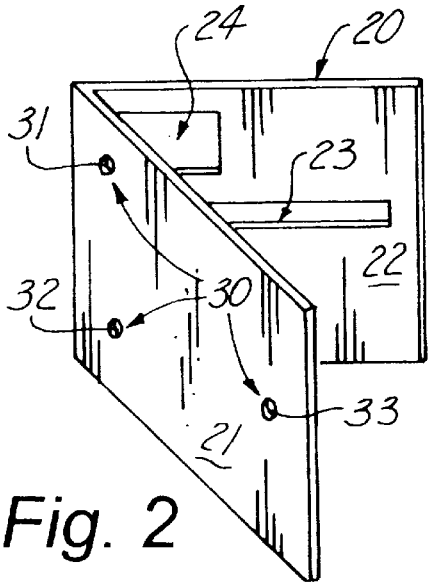
FIG. 2 is a rear perspective view of one of the pair of bracket units that forms the basis of this invention.
Figure 3:
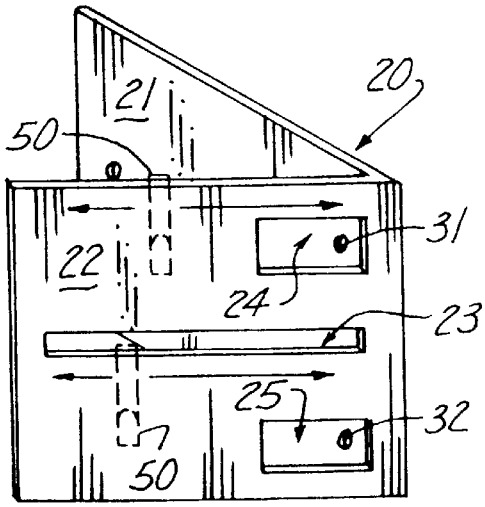
FIG. 3 is a front perspective view of one of the bracket units which forms the preferred embodiment of the invention.

As can best be seen by reference to FIGS. 2 and 3, each bracket unit 11 comprises a generally V-shaped bracket member 20 having a mounting arm 21 and a support arm 22 which are formed integrally with, and disposed at an angle of 45%, relative to one another.

In the preferred embodiment of the invention depicted in FIGS. 2 and 3, it can be seen that the support arm 22 is provided with an elongated transverse central slot 23, and an upper 24 and lower 25 generally rectangular access port disposed adjacent the juncture of the support arm 22 with the mounting arm 21.

Figure 4:
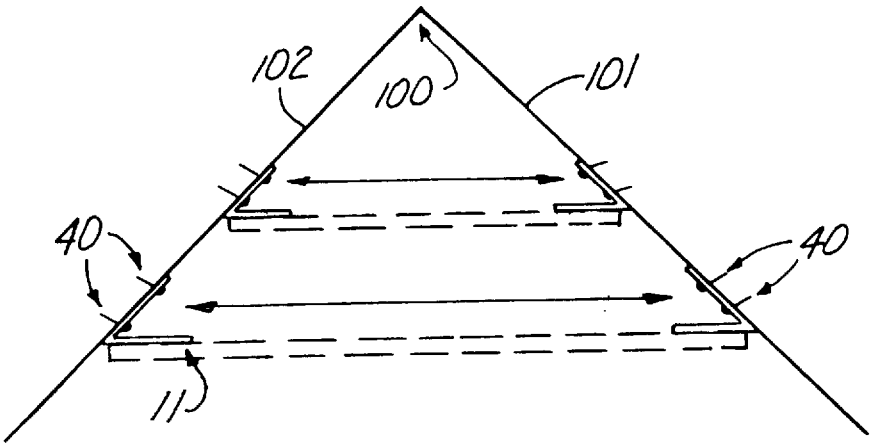
FIG. 4 is a top plan view showing the corner hanging arrangement disposed on the opposed walls of an interior corner.

In addition, as shown in FIGS. 2 and 4, the mounting arm 21 is provided with a plurality of discrete apertures designated generally as 30 dimensioned to receive fastening means 40 for affixing the mounting arm 21 to one of the adjacent wall surfaces 101, 102 of a corner designated generally as 100.

In the preferred embodiment of the invention illustrated in FIGS. 2 and 4, a pair of apertures 31, 32 are disposed proximate the juncture of the support arm 22 and the mounting arm 21 in general alignment with the access ports 24, 25 in the support arm. Furthermore, in the preferred embodiment, a single aperture 33 is centrally disposed relative to the outboard end of the mounting arm 21.

Figure 5:
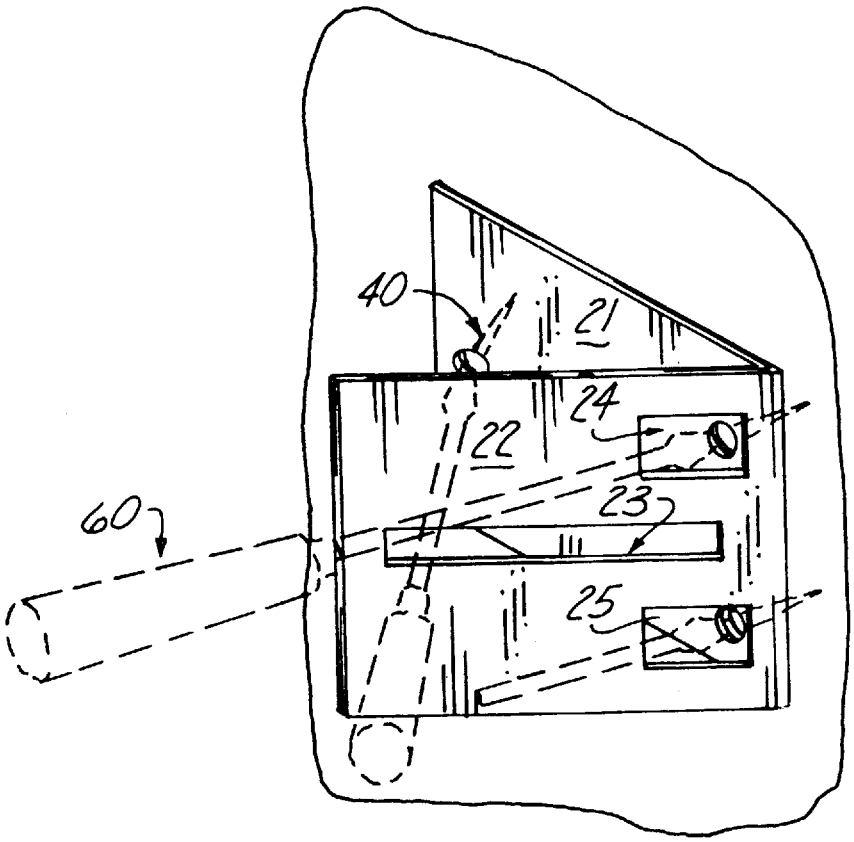
FIG. 5 is a detail view showing how the bracket units can be installed on a wall surface.

As can best be seen by reference to FIGS. 1, 4, and 5, each of the bracket units 11 are intended to be mounted on adjacent corner wall surfaces 101, 102 by a plurality of conventional fastening means 40 which secure the mounting arms 21 in a flush fashion relative to one of the wall surfaces 101, or 102. To that end, the discrete apertures 30 in the mounting arms 21 are dimensioned to receive the fastening means 40 and the access ports 24, 25 etc. are dimensioned to receive conventional fastener driving implements 60 such as screwdrivers or the like for engaging the fastening means 40 in the wall surfaces.

As can also be best appreciated by reference to FIG. 3, the elongated slot 23 in the support arm 22 are dimensioned to receive a portion of a conventional picture hook 50 which will be suspended from the support arm 22 for hanging a piece of artwork 200 in a well recognized fashion.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A corner hanger arrangement for suspending artwork from the adjacent wall surfaces of an interior corner wherein the arrangement comprises:

a pair of bracket units wherein each bracket unit includes a generally V-shaped bracket member having a mounting arm and a support arm formed integrally with one another wherein the mounting arm is disposed at an angle of 45° relative to the support arm, and is further provided with a plurality of discrete apertures adapted to receive a fastener; and wherein each of the support arms is provided with an upper and a lower access port generally aligned with a corresponding selected one of said plurality of discrete apertures and each of the support arms is further provided with at least one centrally disposed elongated slot adapted to receive a portion of a conventional picture hook wherein each of said at least one slots is disposed generally intermediate corresponding ones of said upper and lower access ports, whereby each of said pair of bracket units are capable of being mounted on a corresponding one of the adjacent wall surfaces such that the artwork may be suspended by conventional picture hooks engaging a corresponding one of each of said at least one elongated slot.

* * * * *